United States Patent [19]

Knudson

[11] 3,945,444

[45] Mar. 23, 1976

[54] SPLIT BIT CASING DRILL

[75] Inventor: Gary L. Knudson, Butte, Mont.

[73] Assignee: The Anaconda Company, New York, N.Y.

[22] Filed: Apr. 1, 1975

[21] Appl. No.: 564,133

[52] U.S. Cl. ..... 175/92; 175/171; 175/257

[51] Int. Cl.[2] ..... E21B 1/06; E21B 3/12; E21B 5/00

[58] Field of Search ..... 175/92, 257, 171, 173; 173/73, 80

[56] References Cited

UNITED STATES PATENTS

| | | | |
|---|---|---|---|
| 3,180,433 | 4/1965 | Mason | 173/73 |
| 3,409,081 | 11/1968 | Brown | 175/257 X |
| 3,682,260 | 8/1972 | Klemm | 175/257 X |
| 3,732,143 | 5/1973 | Joosse | 175/171 X |
| 3,835,943 | 9/1974 | Bray | 175/257 X |
| 3,854,539 | 12/1974 | Sweeney | 175/92 |

*Primary Examiner*—David H. Brown

*Attorney, Agent, or Firm*—Pennie & Edmonds

[57] ABSTRACT

An apparatus adapted for drilling earth formations, earth structures or the like essentially embodies an outer tubular means, hollow drill bit means, hammer assembly mechanism, and a rupturable interconnection means. The outer means is rotatable and axially movable having a drilling end insertable within the earth. Connected adjacent the drilling end is the hollow drill bit means which is conjointly rotatable with the outer means. Such outer drill bit means has an anvil impact shoulder formed on the interior surface thereof. The inner drill bit means is located within the outer member and is arranged, in a preferred embodiment, to be conjointly rotatable therewith. A percussion shoulder is integrally formed on the inner drill bit means and is arranged to selectively impact the anvil impact shoulder. The hammer assembly mechanism includes a selectively reciprocally movable hammer within the outer means for intermittently imparting mechanical impulses to the inner drill bit means and the hollow drill bit means through the percussion shoulder to the anvil impact shoulder for downwardly driving the hollow drill bit means and the inner drill bit means. The rupturable interconnection means also serves to rotatably interconnect the hollow drill bit means to the inner drill bit, as well as prevent the inner drill bit means from being forced inwardly or outwardly with respect to the outer means in response to repeated hammerings by the hammer. Additionally, the rupturable means is selected to be rupturable whenever the inner drill bit means and hammer mechanism are pulled upwardly with respect to the outer means by a force sufficient to separate the hollow drill bit means from the inner drill bit means.

5 Claims, 2 Drawing Figures

SPLIT BIT CASING DRILL

BACKGROUND OF THE INVENTION

1. Field of the Invention

This particular invention generally pertains to an apparatus for drilling and casing earth formations and, more particularly, to a novel and improved rotary down-the-hole percussive drill apparatus.

2. Description of the Prior Art

In many particular drilling applications such as water wells, injection and disposal wells, coring, and exploration, it is desirable and often essential that well casing be installed while drilling or upon completion of the drilling process. The casing is installed to reduce or to prevent the risk of lost drill tools or loss of hole, sample contamination, ground water pollution and/or seepage, or to facilitate pumps and other hardware.

At present casing of wells is performed either by the "drill and drive" technique whereby the casing is mechanically driven through the formation before drilling, during drilling or following the drilling bit or by the installation of the casing into a completed borehole of larger diameter. Drilling in loose and unconsolidated materials and in highly fractured ravelly earth formations is often complicated by hole erosion, hole caving, the presence of hard boulders, or large volumes of ground water; and, consequently the hole is difficult or impossible to case. As a result the hole has to be terminated prematurely, redrilled, or a new hole drilled.

For example, in the field of drilling, it has been rather standard operating practice to drill injection wells, which may vary in depth, on top of or into production leach dumps to introduce a leaching solution for well-known purposes. Heretofore, such well drilling procedure has been accomplished through use of cable tool rigs or churm drills which suffered from certain disadvantages in that they were relatively slow and rather expensive in operation.

One approach which was taken to alleviate the aforenoted disadvantages, so as to enable bringing the aforenoted dumps into production sooner, as well as reduce the costs attendant with drilling, employed the use of a truck mounted rotary drill which was equipped with a conventional down-the-hole hammer drill. Whenever, however, such a technique was utilized for drilling and casing wells in situations wherein such factors as ground water and a relatively high percentage of very coarse and unconsolidated material were present, completion of wells was complicated. Although drilling proved to be relatively fast and easy, by reason of the down-the-hole hammer drill, it was somewhat difficult and, in certain circumstances impossible to install casing since the drilled holes would cave as the drill string was pulled out of the hole. As a consequence thereof, casing or well completion operations in these circumstances were unable to be satisfactorily performed.

Another known approach is generally described in U.S. Pat. No. 3,682,260, wherein there is disclosed a down-the-hole hammer drill with a removable inner drill bit cooperating with an annular drill bit. Such an approach, however, does not provide adequate assurances that the inner drill bit will not be forced outwardly through the open bottom end of the outer drill rod through the repeated hammerings of the hammer drill. Accordingly, if the inner drill were so forced outwardly the drilling apparatus would, of course, fail to perform its intended operation. Additionally, this particular form of construction is somewhat more complicated in that it requires the utilization of an inner drill pipe to rotate the inner drill bit.

SUMMARY OF THE INVENTION

It, accordingly, becomes an object of the instant invention to overcome the aforementioned shortcomings normally associated with completing and casing a well by providing a novel and improved down-the-hole drill assembly with a split bit drill which quickly and easily facilitates the drilling and casing of wells.

Briefly stated, the present invention contemplates an apparatus for drilling earth formations or the like which basically comprises an outer tubular means, a hollow drill bit, an inner drill bit, a hammer assembly mechanism, and a rupturable interconnection means.

The split bit drill is intended to eliminate the problem of losing holes or not completing wells where casing is required. The split bit invention assures the completion and the casing of a well regardless of depth; lithology, down hole conditions, or size. The invention allows any well to be completed to its intended depth using the outer tubular means, hollow drill bit means, inner drill bit means, hammer assembly mechanism, and a rupturable interconnection means. Casing the completed well or the installation of casing is accomplished by one of two methods. Upon shearing or rupturing the rupturable interconnection means, the hammer assembly mechanism and the inner drill bit means are withdrawn or retrieved from the outer tubular means and the hollow drill bit means by standard wireline retrieval methods. Casing can then be installed through the interior of the outer tubular means and the hollow drill bit means and the latter two consequently withdrawn from the well leaving the casing.

As an alternative the outer tubular means can be comprised of standard well casing sections on the hollow drill bit means comprised of a standard casing drive shoe containing a plurality of strategically placed button type insert cutting bits. Upon completion of the hole the hammer assembly mechanism and the inner drill bit means are withdrawn, as previously discussed. The outer tubular means in effect becomes the casing and remains in the completed hole.

The outer means may be defined by a generally elongated, rotatable, and axially movable outer tubular drill rod having a drilling end which is insertable within the earth. The hollow or outer drill bit is rotatably connected adjacent the lower end of such drill rod so as to be conjointly rotatable therewith. A generally annular upwardly facing anvil impact shoulder is formed on the interior surface on the outer drill bit. The inner drill bit is adapted to be generally centrally located within and adjacent the drill end of the drill rod. In a preferred embodiment, it is rotatably interconnected with the drill rod so as to be conjointly movable therewith. Such inner drill bit has a generally downwardly facing percussive annular shoulder which is complementary to and contacts the anvil shoulder of the outer or hollow drill bit for purposes of transmitting mechanical impulses to the latter. The hammer drill assembly mechanism is conventional and includes an impact hammer which is selectively reciprocally movable in known fashion within the drill rod. This impact hammer also normally serves to intermittently impart mechanical percussive impulses directly onto a top surface of the inner drill bit.

The rupturable interconnection means of the present invention may be defined by at least a single rupturable steel pin which normally serves to rotatably interconnect the hollow drill bit to the inner drill bit, as well as fixedly maintain the relative positions between the former and the latter. The rupturable steel pin is structurally designed so that it will positively retain the relative positions between the inner and hollow drill bits, regardless of the repeated poundings such inner drill bit receives from the hammer drill bit assembly. Accordingly, the likelihood that such inner drill may be forced inwardly or downwardly and outwardly from the bottom of the hollow drill bit is significantly reduced or even eliminated. Moreover, to facilitate the casing of the well, the rupturable steel pin is designed to rupture whenever the inner drill bit and hammer assembly mechanism are pulled upwardly and withdrawn from the drill rod by sufficient force. Thereafter, a plastic or steel casing, such as of the type used to case injection or water wells, may be placed into the interior of the drill rod. Subsequently, the drill rod may be pulled out of the hole leaving a completed and cased hole. As an alternative, the drill rod may be left in the hole to in effect become the casing for the completed hole.

BRIEF DESCRIPTION OF THE DRAWINGS

The above, as well as other objects, features, and advantages of the present invention will become readily apparent upon a detailed reading of a preferred embodiment of the present invention when viewed in conjunction with the accompanying drawings wherein like reference numerals indicate like structure throughout the several views.

DESCRIPTION OF A PREFERRED EMBODIMENT

Figure 1:
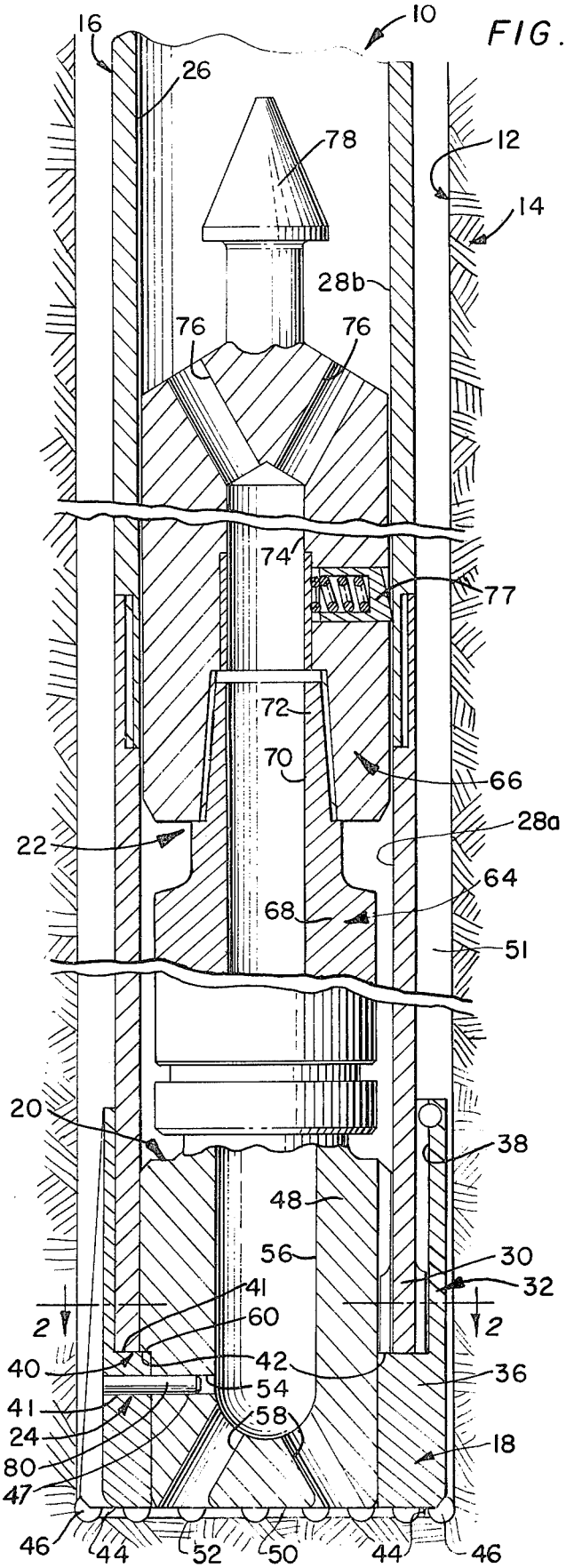
FIG. 1 is a longitudinal partial cross sectional view of a drill apparatus embodying the principles of the present invention.

Referring now, in particular, to FIG. 1 of the drawings, there is disclosed a novel and improved split bit casing drill apparatus embodying the princples of the present invention and generally designated by reference numeral 10. Such split bit casing drill 10 is particularly adapted for use in the drilling and casing of a typical well 12 drilled in various kinds of earth formation 14 or the like, in which it is desired to case the well, while at the same time being able to be withdrawn for future operations.

The split bit casing drill 10 of the preferred embodiment, may basically include an outer tubular means 16, hollow or outer drill bit means 18, inner drill bit means 20, hammer assembly mechanism 22, and a rupturable interconnection means 24.

In the embodiment illustrated in FIG. 1, the outer tubular means 16 may be defined by a generally elongated, rotatable, and axially movable tubular drill rod 26 which may be normally comprised of a plurality of elongated standard tubular well sections or drill rod segments 28*a*, *b*, only two of which are shown. Such segments may be suitably connected in axial alignment, in a manner well known in the art, such as by cooperating splined portions or the like. Drill rod 26, as is typical, is connected at its upper end to a rotary drive means (not shown) which appropriately drivingly rotates the drill rod in the earth formation 14. As will be more specifically described hereinafter, the drill rod 26 can be retracted from well 12 formed in earth structure 14, after, of course, such well has been properly cased or can be left in the hole to in effect become the casing which remains in the completed hole. In addition to the rotating motion imparted to the drill rod member 26, such rod member is also normally hammered into the earth formation 14 in a manner to be presently described.

Figure 2:
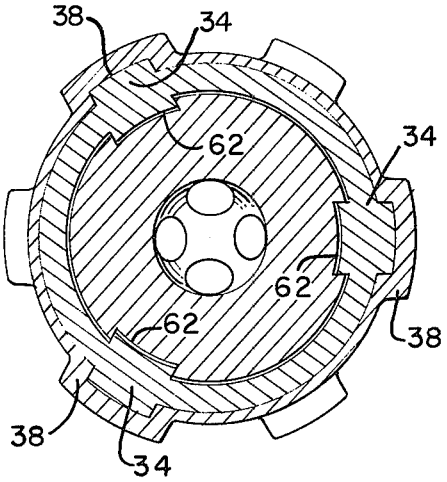
FIG. 2 is a sectional view taken substantially along section line 2—2 appearing in FIG. 1 looking in the direction of the arrows and illustrating greater structural detail of the present invention.

As perhaps best depicted in FIG. 2, there is situated at the opposite or drilling end 30 of the drill rod 26 a coupling means 32. The coupling means 32 may be defined by three projections 34 which, as will be more fully described, are arranged to drivingly interconnect both the outer and inner drill bit means, 18 and 20, respectively. In such a manner, both of the drill bit means 18 and 20 may rotate in unison with one another to provide for a more uniform cutting action. Although this particular embodiment has been described with three integrally formed projections 34, it should be herein pointed out that other well known types of devices for drivingly interconnecting the outer and inner drill bit means 18 and 20 might also be used. Moreover, by virtue of this type of connection, a much simpler drive for the inner drill bit means 20 is provided and one which may dispense with, for example, a rotary driven inner drill rod for driving the inner drill bit 20.

Outer or hollow drill bit means 18 is essentially comprised of a generally annular tubular bit member 36 which may be conveniently secured to the drilling end 30 in any known manner. As best illustrated in FIGS. 1 and 2, three radially spaced receiving slots 38 are formed, each of which respectively receives therein the exterior portions of the coupling projection 34. Accordingly, the drill rod 26 and outer drill bit means 18 are conjointly rotatable. Interiorly formed in the bit member 36 may be a generally radially inwardly extending and upwardly facing impact shoulder 40 which may either be generally continuously annular or segmented. A portion of such anvil impact shoulder 40 is adapted to be fitted against the end surface 41 of the bottom-most segment 28*a* forming the elongated rotary drill member 26. The impact shoulder 40 of the instant invention is formed with a generally annular radial extending section 42. Such radial section 42 extends generally radially inwardly with respect to the drill rod member 26 and is so arranged to abut and transmit the percussive mechanical impulses which are transmitted thereto by the inner drill bit means 20 cooperating therewith in a manner to be more fully described. Located at the cutting end 44 of outer drill bit 36 are a plurality of a well known type of discrete and spaced generally spherical-ended button type insert cutting bits 46 which may be fabricated of suitable material, such as steel or tungsten carbide. At least one generally radially extending opening 47 extends through outer drill bit 36 for purposes of frictionally receiving the rupturable means for purposes afterwards made clear.

With continued reference to FIGS. 1 and 2, the inner drill bit means 20 may be defined by any suitable and conventional drill bit 48 and is illustrated as being centrally located with respect to the drill rod 26. Such inner drill bit 48 has a cutting or drilling end 50. As more clearly shown in FIG. 1, a plurality of discrete and spaced generally spherical-ended button type insert cutting bits 52 which may be generally similar in structure and function to cutting button-type bits 46 are inserted into drilling end 50. Such inner cutting bit inserts 52 serve to cut through the earth formation 14. At least one radially inwardly extending receiving opening 54 is formed in inner drill bit 28. Such opening 54 is designed to frictionally receive a portion of the rupturable means 24. A cavity 56 is centrally formed in inner drill bit 48 and has a plurality of circumferentially spaced generally downwardly and outwardly formed fluid passages 58 which permits flushing fluid, such as pressurized air, to flow therethrough, in a conventional manner, to thereby permit carrying away of cutting debris from drill ends 44 and 50 up and through the well annulus 51. Positioned at the intermediate end of the inner drill bit 48 is a substantially annular percussive surface 60 which receives the percussive impulses from the hammer assembly mechanism 22 to be presently described. In this arrangement, the percussive surface 60 will directly contact and transmit the mechanical forces to the impact shoulder 40 to provide for greater transmission of such impact forces. Formed on the external periphery of the upper end of the inner drill bit 48 are a plurality of circumferentially spaced generally longitudinally extending grooves 62 which slidably interfit with the opposed or interior portions of the coupling projections 34, such as indicated in FIG. 2. By this particular arrangement, it will be appreciated that inner drill bit 48 is rotatably secured to drill rod 26 and axially slidable with respect thereto. The purpose served by the relative slidable interconnection is to facilitate withdrawal of the inner drill bit 48 from the drill rod member 26 for reasons well known in the art. In the preferred embodiment, this type of interconnection acts to, in a very simple manner, drivingly rotate the inner drill bit 48 without, for example, a relatively complicated and expensive inner drill pipe which is conveniently utilized in certain circumstances.

The hammer assembly mechanism 22 of the present embodiment may be any conventional down-the-hole type and may be comprised of a hammer drill section 64 and an anvil section 66. Such hammer drill section 64 is designed to impart intermittent blows to the inner drill bit 48 and may be defined by any conventional well known type of reciprocally movable down-the-hole percussive hammer 68 currently used in the field. Therefore, a detailed description as to its construction and operation is not deemed necessary for an understanding of the present invention. However, for an appreciation of its operation, in context with the present embodiment, it will be sufficient to note that the percussive hammer 68 is appropriately connected to inner drill bit 48, in conventional fashion. As a result of this kind of arrangement, mechanical impulses may be repeatedly and intermittently transmitted to the inner drill bit means 20 from the hammer assembly mechanism 22. In addition, such hammer mechanism 22 may selectively withdraw inner drill bit 48 from the outer drill bit 36. A central passageway 70 is also formed in the hammer drill section 64 which enables the flushing fluid to pass to and through passages 58 formed in inner drill bit 48 as well as serve to reciprocate hammer 68 in conventional manner. The upper portion of the hammer drill section 64 has a reduced diameter spline portion 72 which facilitates its interconnection to the anvil section 66. Anvil section 66 is connected to hammer section 64 by any suitable means (not shown) so as to be able to conjointly linearly move therewith. In this manner, withdrawal is facilitated.

Anvil section 66 is conventional and essentially serves as a heavy weight which acts to maintain the hammer drill section 64 in proper position for successfully performing its operation. It also has a fluid passageway 74 centrally formed therein which communicates with the passageway 70 formed in the hammer drill section 64. A plurality of circumferentially spaced inlet passageways 76 are located such that they all converge to the top of the anvil passageway 74 for similarly passing the flushing fluid to the drill end surfaces 44 and 50. Intermittently, located in the peripheral surface is at least one spring biased weight detent 77 which, in a conventional manner, latches the anvil section 66 to drill rod 26, and also permits upward movement of such anvil section 66 upon withdrawal. A spearhead 78 is integrally formed and located on the top of anvil section 66 which enables the standard wire-line retriver (not shown) to engage therewith. As is known, such wire-line retriever may, through conventional dogs, also not depicted, retract the entire hammer mechanism assembly 22 as well as the inner drill bit means 20 for purposes to be presently described.

With particular reference to FIG. 1, the rupturable interconnection means 24 of the present invention is defined by at least one relatively rigid pin member 80 which may be made of suitable material such as, for example, steel. Although an individual pin 80 has been depicted, it is, of course, within the spirit and scope of the present invention that a plurality of such pins may be suitably employed without departing from the scope of the present invention. In the embodiment illustrated in FIG. 1 opposite ends of pin 80 are frictionally received within openings 47 and 54 formed in the outer and inner drill bit means 18 and 20, respectively. The material for pin 80 is selected, however, so that it has sufficient strength and rigidity to prevent the inner drill bit 48 from being forced outwardly or inwardly from the bottom of the outer bit 36 as a result of the repeated poundings of the percussive hammer 68. It should be pointed out, however, that the material for the pin 80 is selected so that it will shear or rupture upon application of a sufficient shearing force. It is envisioned that this rupture force will be the retraction force applied by the standard wire-line retriever ordinarily used to, as previously mentioned, withdraw the hammer and anvil sections 64 and 66, respectively, as well as inner drill bit 48. Additionally, by reason of the type of interconnection aforedescribed, pin 80 directly serves to provide another path for transmitting rotation from drill rod 26 to the inner drill bit 48. While the rupturable interconnection means 24 has been described for use in a casing drill in which the inner drill bit 48 is rotated directly through drill rod 26 it should be noted that even if drill bit 48 were rotated through an inner drill pipe or the like, such pin 80 may be used in such an arrangement.

Having thus described a preferred embodiment of the present invention, its basic mode of operation will be briefly set forth.

During a drilling operation, the drill rod 26 is suitably rotatably driven. The projections 34 of coupling means 32 serve to continuously rotatably drive the outer and inner drill bits 36 and 48 so as to effect drilling of the earth formation 14. At the same time as the drill rod 26 is continuously rotated the hammer assembly mechanism 22 repeatedly and intermittently applies impact blows to inner drill bit 48. The impacts are in turn transmitted through percussive impact shoulder 60 which engages impact shoulder 40 formed on outer drill bit 36 to correspondingly downwardly drive outer drill bit 36. As a consequence of the foregoing arrangement, the outer and inner bits 36 and 48 are continuously advanced in the axial direction by the percussive effect of the hammer assembly mechanism. At the completion of the drilling operation and whenever it is desired to case the newly drilled well 12, the inner drill bit 48, hammer drill section 64, and anvil section 66 are withdrawn. As indicated previously, the standard wire retrieval effects the withdrawal. As a result of such withdrawal, the rupturable pin 80 is sheared thereby permitting drill rod 26 to temporarily remain. After withdrawal, a suitable casing member (not shown) is suitably and centrally inserted within drill rod 26. Thusly, drill rod 26 may thereafter be successively withdrawn for future use while the casing remains. As an alternative, drill rod 26 can be left in the newly drilled well 12 and thereby becomes the casing. It will, therefore, be appreciated that the casing drill 10 of the present invention enables casing of wells even with use of down-the-hole hammer.

While the invention has been described in connection with the preferred embodiment, it is not intended to limit the invention to the particular form set forth above, but, on the contrary, it is intended to cover such alternatives, modifications, and equivalents as may be included within the spirit and scope of the invention as defined by the appended claims.

What is claimed is:

1. In an apparatus adapted for drilling and casing earth formations, earth structures, or the like comprising a rotatable and axially movable tubular outer means having a drilling end, hollow drill bit means connected adjacent said drilling end and conjointly rotatable with said outer means and having an anvil impact shoulder in the interior of said hollow drill bit means, rotatable inner drill bit means generally centrally disposed within said outer means for drilling the earth formation and having a percussion shoulder for contacting said anvil shoulder, hammer assembly means including a selectively reciprocally movable hammer within said outer means for intermittently impacting mechanical impulses to said inner drill bit means and said hollow drill bit means through the percussion shoulder to said anvil impact shoulder for downwardly driving said hollow drill bit means and said inner drill bit means, the improvement comprising, rupturable interconnection means rotatably interconnecting said hollow drill bit means to said inner drill bit means, as well as preventing said inner drill bit means from being pulled in or forced out from said outer means in response to repeated hammerings by said hammer, and also being rupturable whenever said inner drill bit means and said hammer assembly means are pulled upwardly with force sufficient to separate from said hollow drill bit means said inner drill bit means.

2. An apparatus as defined in claim 1 in which said outer means is formed with coupling means which drivingly cooperates with said inner drill bit means for conjointly rotating the latter therewith.

3. An apparatus as defined in claim 1 in which said rupturable means is comprised of at least one elongated pin member.

4. An apparatus as defined in claim 3 in which said pin member is defined by a steel pin.

5. An apparatus adapted for drilling and casing earth formations, earth structures, or the like comprising a rotatable and axially movable tubular outer means having a drilling end; coupling means located adjacent said drilling end; hollow drill bit means connected adjacent said drilling end and being conjointly rotatable with said outer means and having an anvil impact shoulder in the interior of said hollow drill bit means; rotatable inner drill bit means generally centrally disposed within said outer means and being rotatably connected to said coupling means for drilling the earth formation; said inner drill bit means having a percussion shoulder for contacting said anvil shoulder; hammer assembly mechanism including a selectively reciprocally movable hammer within said outer means for intermittently imparting mechanical impulses to said inner drill bit means and said hollow drill bit means through said percussion shoulder to said anvil impact shoulder for downwardly driving said hollow drill bit means and said inner drill bit means, and rupturable interconnection means being defined by at least one elongated pin member rotatably interconnecting said hollow drill bit means to said inner drill bit means, as well as preventing said inner drill bit means from being pulled in or forced out from said outer means in response to repeated hammerings by said hammer, and also being rupturable whenever said inner drill bit means and said hammer mechanism are pulled upwardly with force sufficient to separate from said hollow drill bit means said inner drill bit means.

* * * * *